US011739607B2

(12) United States Patent
Aleid

(10) Patent No.: US 11,739,607 B2
(45) Date of Patent: Aug. 29, 2023

(54) MULTI-EXPANSION PACKER SYSTEM HAVING AN EXPANDABLE INNER PART DISPOSED WITHIN AN OUTER PART OF THE PACKER

(71) Applicant: Saudi Arabian Oil Company, Dhahran (SA)

(72) Inventor: Abdulrahman K. Aleid, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/457,367

(22) Filed: Dec. 2, 2021

(65) Prior Publication Data

US 2023/0175343 A1 Jun. 8, 2023

(51) Int. Cl.

| | |
|---|---|
| ***E21B 33/12*** | (2006.01) |
| ***E21B 47/117*** | (2012.01) |
| ***E21B 23/06*** | (2006.01) |
| ***E21B 33/127*** | (2006.01) |

(52) U.S. Cl.

CPC ..... *E21B 33/1208* (2013.01); *E21B 23/06* (2013.01); *E21B 33/127* (2013.01); *E21B 47/117* (2020.05)

(58) Field of Classification Search

CPC ..... E21B 33/1208; E21B 47/117; E21B 33/127

See application file for complete search history.

(56) References Cited

U.S. PATENT DOCUMENTS 4,067,349 A * 1/1978 Austin ..... G01M 3/2853 73/40.5 R
4,627,471 A * 12/1986 Parkes ..... F16L 55/16455 138/97

(Continued)

FOREIGN PATENT DOCUMENTS

CA 2462195 C 6/2007
CN 212003110 U 11/2020

(Continued)

OTHER PUBLICATIONS

Inflatable Packers, Saltel Industries, https://www.saltel-industries.com/inflatable-packers-2/, retrieved Aug. 2, 2021.

(Continued)

*Primary Examiner* — Theodore N Yao
(74) *Attorney, Agent, or Firm* — Leason Ellis LLP

(57) ABSTRACT

A multi-expansion packer is deployed in a borehole. The multi-expansion packer includes an outer part and an inner part disposed within the outer part. An outer part pump expands the outer part with a first fluid to engage the outer part with an inner surface of the borehole. A leakage sensor is configured to detect a leakage of the first fluid from the outer part which causes at least a portion of the outer part to disengage from the inner surface. An inner part pump expands the inner part with a second fluid. A controller responds to the detected leakage to control the inner part pump to pump the second fluid into the inner part until at least the disengaging portion of the outer part re-engages the inner surface of the borehole. A method comprises steps performed during operation of the system.

14 Claims, 5 Drawing Sheets

(56) References Cited

U.S. PATENT DOCUMENTS

| | | | | |
|---|---|---|---|---|
| 6,865,934 | B2 * | 3/2005 | Schultz | G01V 9/02 73/152.36 |
| 7,866,387 | B2 | 1/2011 | van Zuilekom et al. | |
| 7,909,095 | B2 | 3/2011 | Richards et al. | |
| 8,091,634 | B2 | 1/2012 | Corre et al. | |
| 9,016,391 | B1 | 4/2015 | Chauffe | |
| 9,835,023 | B2 | 12/2017 | Hallundbæk et al. | |
| 9,963,952 | B2 | 5/2018 | Hallundbæk et al. | |
| 10,180,039 | B2 | 1/2019 | Saltel et al. | |
| 11,002,130 | B2 | 5/2021 | Fripp et al. | |
| 2005/0110217 | A1 * | 5/2005 | Wood | E21B 33/1208 277/333 |
| 2008/0110626 | A1 * | 5/2008 | Allison | E21B 33/127 166/288 |
| 2021/0180427 | A1 * | 6/2021 | Zonoz | E21B 33/127 |

FOREIGN PATENT DOCUMENTS

| | | | | |
|---|---|---|---|---|
| GB | 2399368 | A * | 9/2004 | E21B 33/127 |
| WO | WO-03060281 | A2 * | 7/2003 | E21B 33/1243 |
| WO | 2019164499 | A1 | 8/2019 | |

OTHER PUBLICATIONS

ZoneGuard HE Packer, Halliburton, Nov. 18, 2018.

Jaswell Seal (Well Packer), https://www.aquascience.net/jaswell-seal-well-packer, retrieved Aug. 2, 2021.

REBarrier slide-on swellable packer, Baker Hughes, https://www.bakerhughes.com/completions/packers/openhole-packers/rebarrier-slideon-swellable-packer, retrieved Aug. 2, 2021.

Inflatable Packers, Aardvark Packers, https://www.aardvarkpackers.com/products-list/inflatable-packers/, retrieved Aug. 2, 2021.

* cited by examiner

MULTI-EXPANSION PACKER SYSTEM HAVING AN EXPANDABLE INNER PART DISPOSED WITHIN AN OUTER PART OF THE PACKER

FIELD OF THE DISCLOSURE

The present disclosure relates generally to packers in the oil and gas industry, and, more particularly, to a multi-expansion packer deployed in a borehole of a well.

BACKGROUND OF THE DISCLOSURE

Packers positioned in boreholes of wells have a risk of leaking when deployed and contacting an inner surface of the borehole. Leaking packers can then disengage from contacting the inner surface, and so such leaking packers lack structural integrity as oil or gas is pumped in the well. Accordingly, such leaking packers must be replaced, which involves significant cost in the replacement of the packer itself as well as the cost of the downtime of operation of the well.

SUMMARY OF THE DISCLOSURE

According to an embodiment consistent with the present disclosure, a multi-expansion packer is deployed in a borehole.

In an embodiment, an expandable packer is responsive to detected packer leakage, and comprises a packer assembly, an outer part pump, a leakage sensor, an inner part pump, and a controller. The packer assembly has an outer part and an inner part. The inner part is disposed within the outer part. The packer assembly is positioned at a selected location about a shaft in the borehole. The outer part pump is coupled to the outer part and is configured to expand the outer part with a first fluid to engage the outer part with an inner surface of the borehole. The leakage sensor is configured to detect a leakage of the first fluid from the outer part which causes at least a portion of the outer part to disengage from the inner surface. The inner part pump is coupled to the inner part and is configured to expand the inner part with a second fluid. The controller is responsive to the positioning of the packer assembly at the selected location to control the outer pump to pump the first fluid into the outer part. The controller is also responsive to the detected leakage to control the inner part pump to pump the second fluid into the inner part until at least the disengaging portion of the outer part re-engages the inner surface of the borehole.

At least one of the outer part and the inner part is composed of a rubber bladder. At least one of the outer part and the inner part is composed of a material which swells in response to the first fluid and the second fluid, respectively. At least one of the first fluid and the second fluid is stored in a reservoir. The sensor determines a leakage rate, and the controller controls the inner part pump to pump the second fluid at a fill rate greater than or equal to the leakage rate. At least one of the first fluid and the second fluid is oil obtained from the borehole.

In another embodiment, an expandable packer is responsive to detected packer leakage, and comprises an outer part, an inner part, an outer part pump, a leakage sensor, an inner part pump, and a controller. The outer part is positioned at a selected location about a shaft in a borehole. The inner part is disposed within the outer part. The outer part pump is coupled to the outer part and is configured to expand the outer part with a first fluid to engage the outer part with an inner surface of the borehole. The leakage sensor is configured to detect a leakage of the first fluid from the outer part which causes at least a portion of the outer part to disengage from the inner surface. The inner part pump is coupled to the inner part and is configured to expand the inner part with a second fluid. A controller controls the outer pump to pump the first fluid into the outer part. The controller is responsive to the detected leakage to control the inner part pump to pump the second fluid into the inner part until at least the disengaging portion of the outer part re-engages the inner surface of the borehole.

At least one of the outer part and the inner part is composed of a rubber bladder. At least one of the outer part and the inner part is composed of a material which swells in response to the first fluid and the second fluid, respectively. At least one of the first fluid and the second fluid is stored in a reservoir. The sensor determines a leakage rate, and the controller controls the inner part pump to pump the second fluid into the inner part at a fill rate greater than or equal to the leakage rate. At least one of the first fluid and the second fluid is oil obtained from the borehole.

In a further embodiment, a method responds to detected packer leakage by positioning a packer assembly having an outer part and an inner part at a selected location about a shaft in a borehole with the inner part disposed within the outer part, filling the outer part with a first fluid to expand the outer part to engage an inner surface of the borehole, detecting any leakage of the outer part which causes at least a portion of the outer part from engaging the inner surface using a leakage sensor, and responsive to detected leakage by filling the inner part with a second fluid to expand the inner part until at least the disengaging portion of the outer part re-engages the inner surface of the borehole.

At least one of the outer part and the inner part is composed of a rubber bladder. At least one of the outer part and the inner part is composed of a material which swells in response to the first fluid and the second fluid, respectively. The leakage sensor determines a leakage rate, and the filling of the inner part is performed at a fill rate greater than or equal to the leakage rate. At least one of the first fluid and the second fluid is oil obtained from the borehole.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

It is noted that the drawings are illustrative and are not necessarily to scale.

DETAILED DESCRIPTION OF CERTAIN EMBODIMENTS OF THE DISCLOSURE

Example embodiments consistent with the teachings included in the present disclosure are directed to a multi-expansion packer deployed in a borehole.

Figure 1:
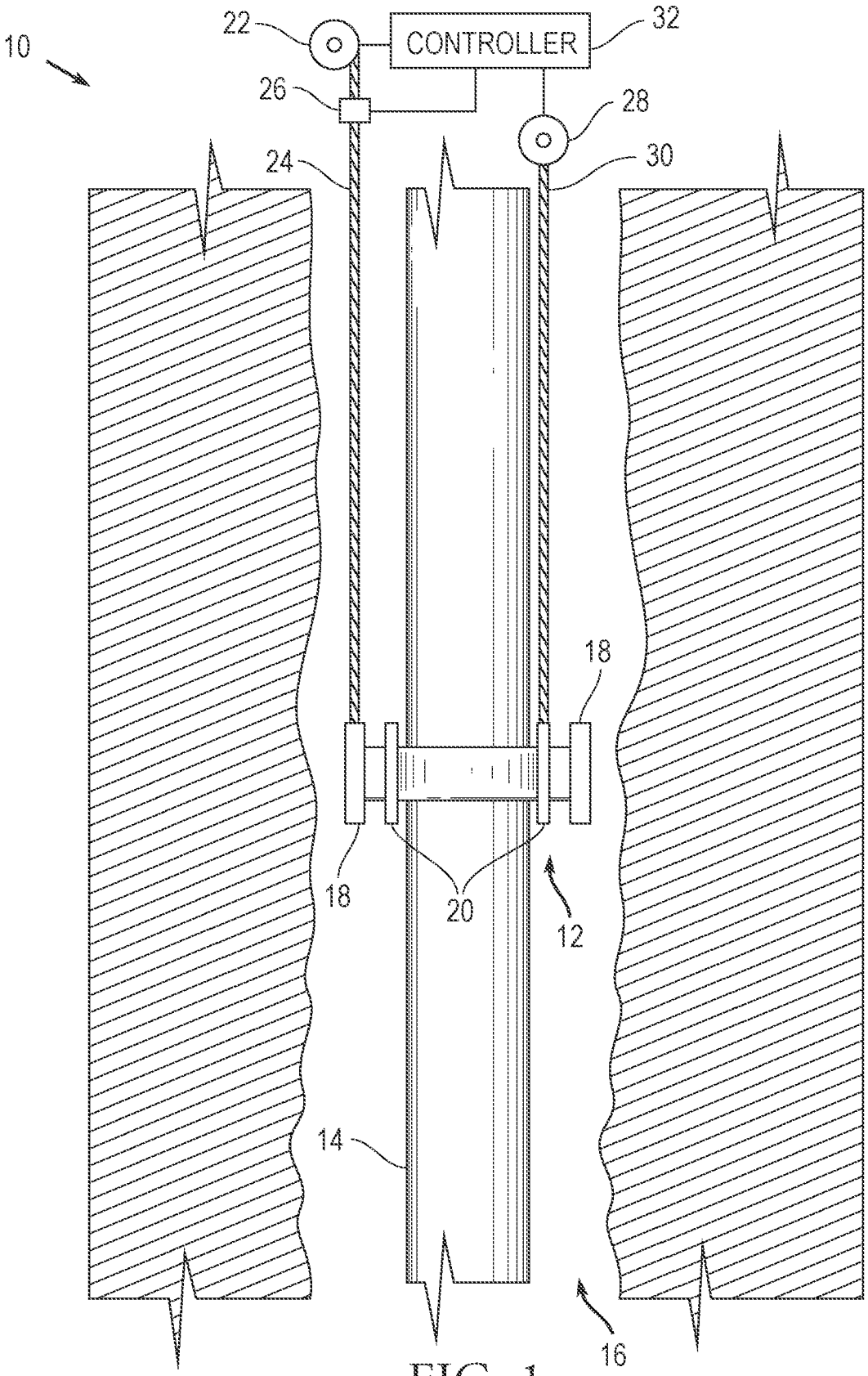
FIG. 1 is a side view of a multi-expansion packer deployed in a borehole in an initial configuration, according to an embodiment.

As shown in FIG. 1, a system 10 includes a packer 12 surrounding a shaft 14 extending in a borehole 16. The packer 12 has an outer part 18 and an inner part 20. In an initial configuration, the outer part 18 and the inner part 20 are not deployed, and so the outer part 18 does not contact the inner surface of the borehole 16. Both of the outer part 18 and the inner part 20 can be bladders configured to expand upon receiving a liquid or a gas. For example, the outer part 18 and the inner part 20 can receive oil from the borehole 16 itself. The outer part 18 and the inner part 20 can be composed of rubber. Alternatively, the inner part 20 can be composed of an absorbent material, such as a sponge, which swells and expands upon receiving a liquid or gas.

The system 10 also includes an outer part pump 22 with an outer part feed line 24 extending to the outer part 18, and configured to pump a liquid or gas from a reservoir into the outer part 18 to expand the outer part 18. The system 10 has a leakage sensor 26 coupled to the outer part feed line 24 and configured to detect any leakage from the outer part 18. For example, leakage of the outer part 18 can result in a drop in pressure of the liquid or gas in the outer part feed line 24 detected by a pressure sensor, for instance. The system 10 also includes an inner part pump 28 with an inner pump feed line 30 extending to the inner part 20, and configured to pump a liquid or gas from a reservoir into the inner part 20 to expand the inner part 20. A controller 32 controls the operation of the pumps 22, 28. The controller 32 also receives a signal from the leakage sensor 26 indicating whether leakage is detected in the outer part 18. The signal from the leakage sensor 26 can also represent a rate of leakage of the liquid or gas from the outer part 18.

Figure 2:
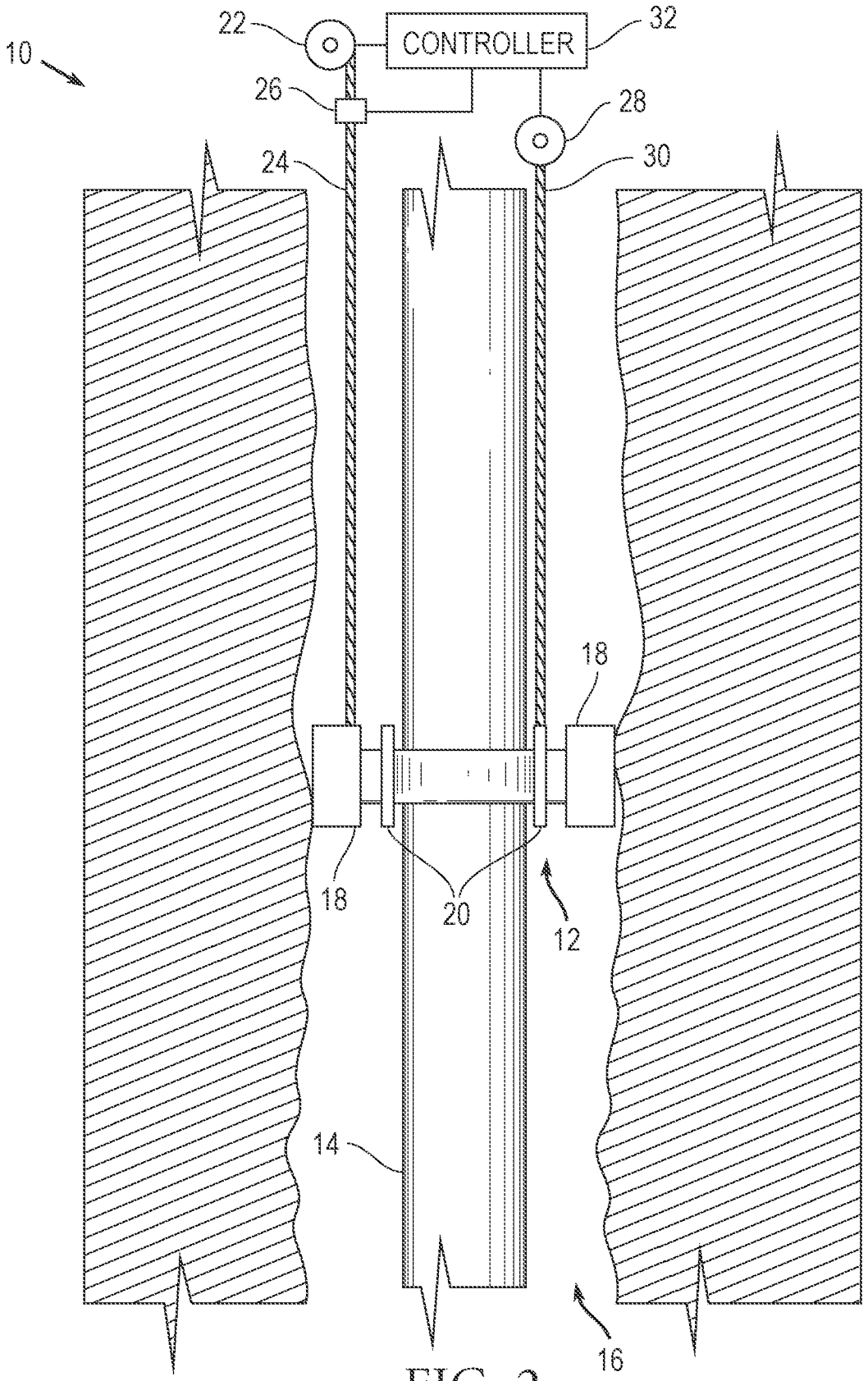
FIG. 2 is a side view of the multi-expansion packer with an outer part deployed.
Figure 3:
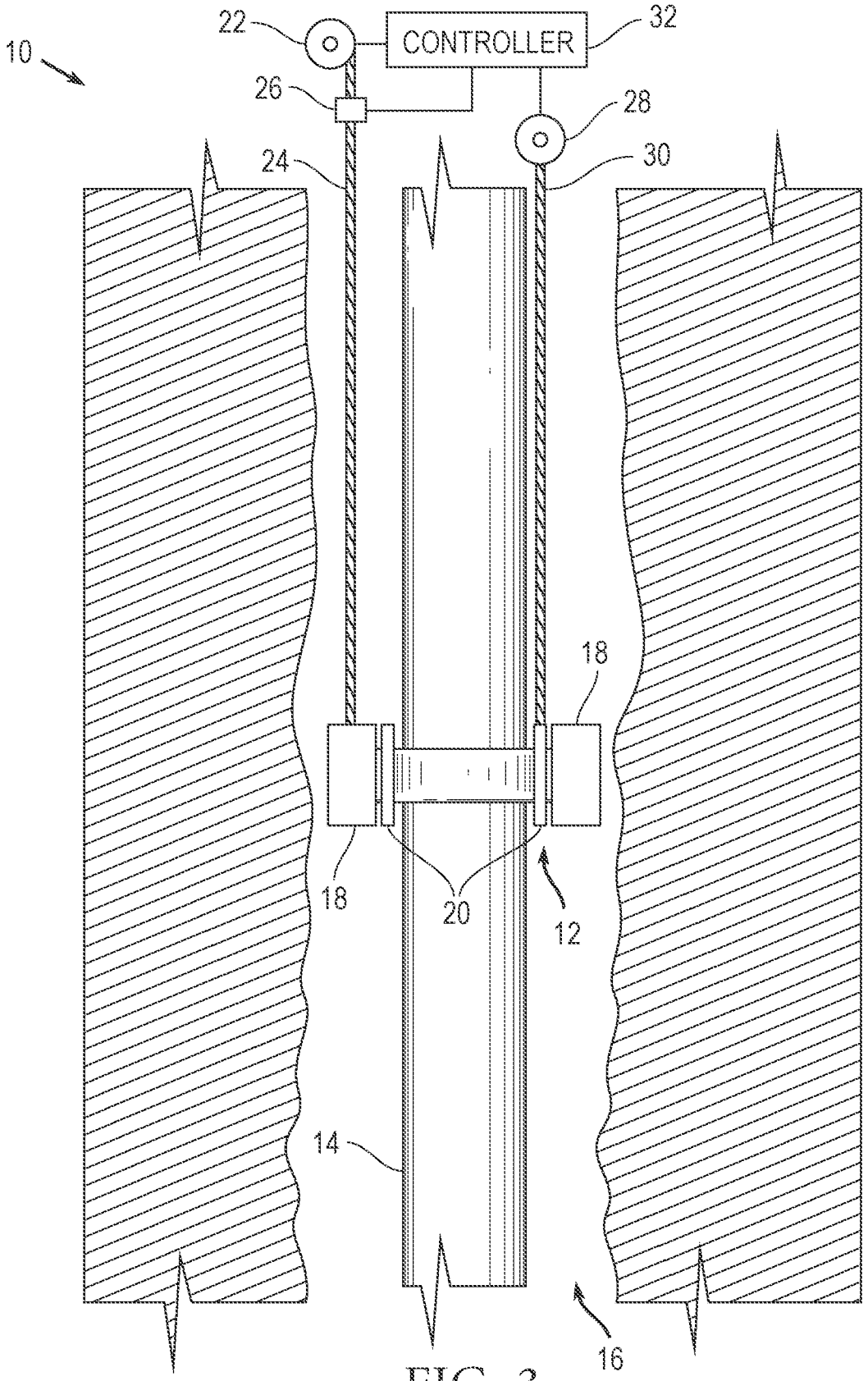
FIG. 3 is a side view of the multi-expansion packer with an outer part experiencing leakage.

As shown in FIG. 2, the controller 32 generates and outputs an outer pump control signal to the outer part pump 22. In response to the outer pump control signal, the outer part pump 22 then expands the outer part 18 upon pumping of a liquid or gas into the outer part 18 by pumping action of the outer part pump 22. Accordingly, the outer part 18 of the packer 12 is expanded to be deployed to engage the inner surface of the borehole 16. As shown in FIG. 3, due to leakage of the expanding liquid or gas from the outer part 18, at least a portion of the outer part 18 retracts from a portion of the inner surface of the borehole 16. The leakage sensor 26 detects such leakage, and transmits a leakage signal to the controller 32.

Figure 4:
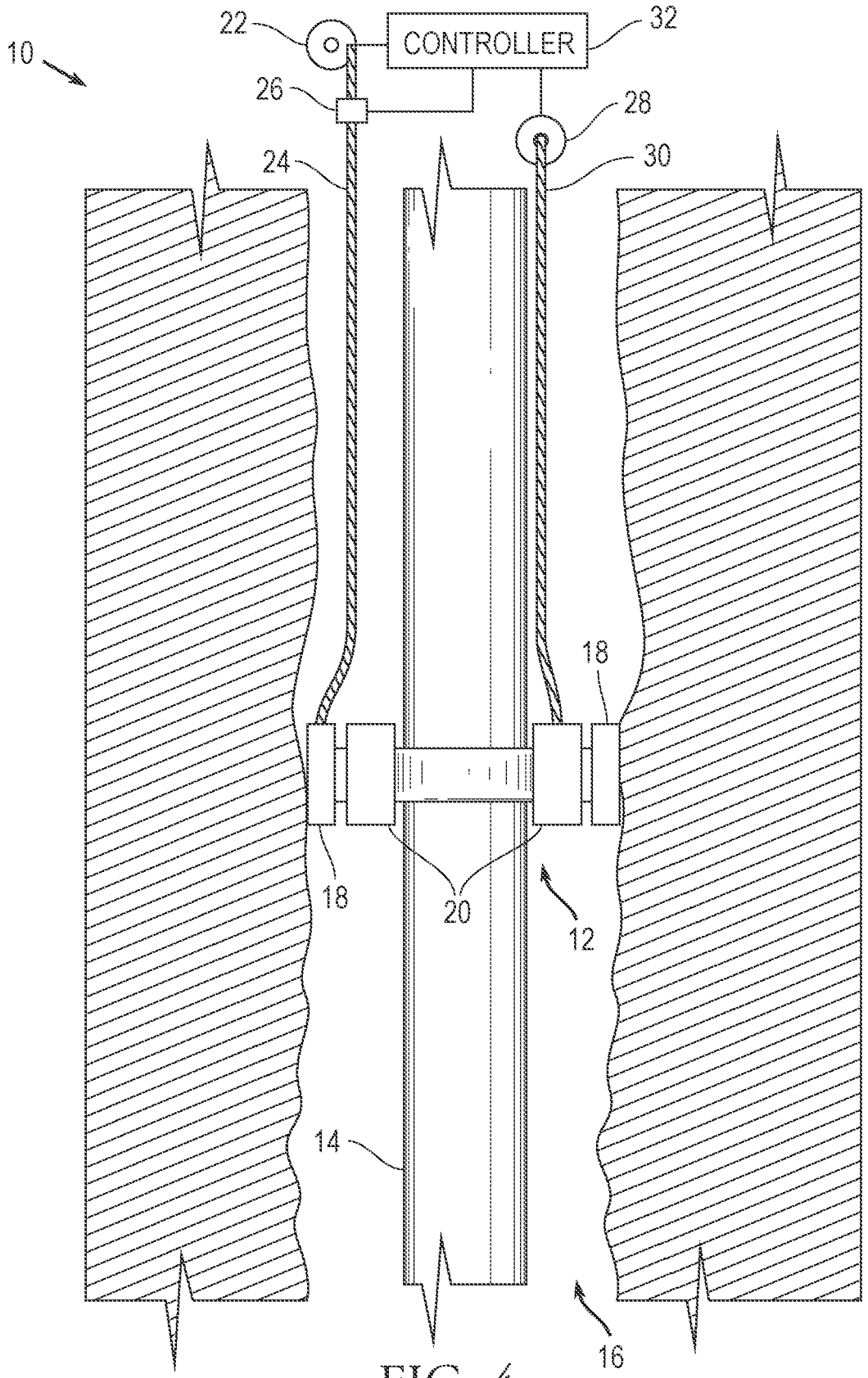
FIG. 4 is a side view of the multi-expansion packer with an inner part deployed.

As shown in FIG. 4, in response to the leakage signal, the controller 32 generates and outputs an inner pump control signal to the inner part pump 28. In response to the inner pump control signal, the inner part pump 28 then expands the inner part 20 upon pumping of a liquid or gas into the inner part 20 by pumping action of the inner part pump 28. The controller controls the inner part pump 28 to pump the fluid or gas at a fill rate greater than or equal to a leakage rate. Accordingly, the inner part 20 of the packer 12 is expanded to cause the outer part 18 to re-engage the inner surface of the borehole 16.

Figure 5:
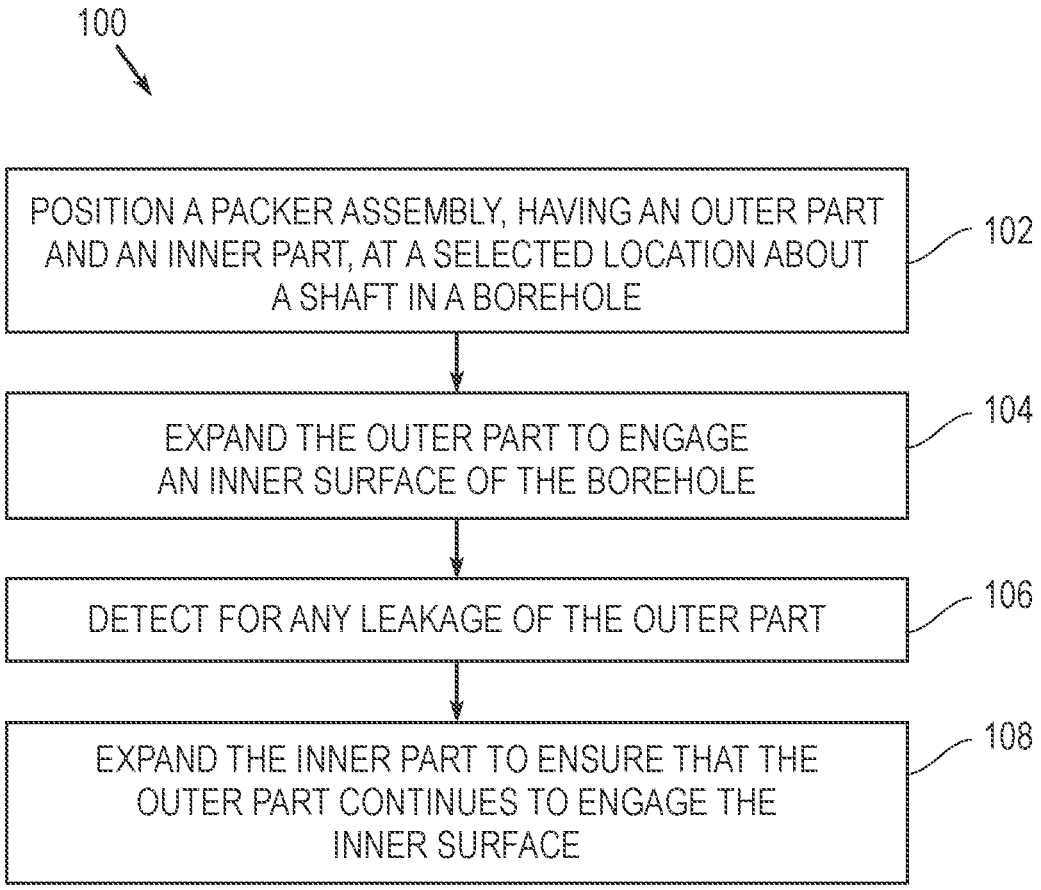
FIG. 5 is a flowchart of a method of operation, according to an embodiment.

Referring to FIG. 5, a method 100 includes positioning the packer assembly 12, having the outer part 18 and the inner part 20, at a selected location about the shaft 14 in the borehole 16 in step 102. The method 100 then expands the outer part 18 to engage an inner surface of the borehole 16 in step 104. The method 100 then detects for any leakage of the outer part 18 using the leakage sensor 26 in step 106. The method 100 then expands the inner part 20 to ensure that the outer part 18 continues to engage the inner surface of the borehole 16 in step 108.

Portions of the methods described herein can be performed by software or firmware in machine readable form on a tangible (e.g., non-transitory) storage medium. For example, the software or firmware can be in the form of a computer program including computer program code adapted to cause the controller to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations.

What is claimed is:

1. An expandable packer which is responsive to detected packer leakage, comprising:

a packer assembly having an outer part and an inner part, with the inner part disposed within the outer part, and with the packer assembly positioned at a selected location about a shaft in a borehole;

an outer part pump coupled to the outer part and configured to expand the outer part with a first fluid to engage the outer part with an inner surface of the borehole;

a leakage sensor configured to detect a leakage of the first fluid from the outer part which causes at least a portion of the outer part to disengage from the inner surface;

an inner part pump coupled to the inner part and configured to expand the inner part with a second fluid; and a controller responsive to the positioning of the packer assembly at the selected location to control the outer pump to pump the first fluid into the outer part, and the controller responsive to the detected leakage to control the inner part pump to pump the second fluid into the inner part until at least the disengaging portion of the outer part re-engages the inner surface of the borehole.

2. The system of claim 1, wherein at least one of the outer part and the inner part is composed of a rubber bladder.

3. The system of claim 1, wherein at least one of the outer part and the inner part is composed of a material which swells in response to the first fluid and the second fluid, respectively.

4. The system of claim 1, wherein at least one of the first fluid and the second fluid is stored in a reservoir.

5. The system of claim 1, wherein the sensor is configured to determine a leakage rate, and wherein the controller is configured to control the inner part pump to pump the second fluid at a fill rate greater than or equal to the leakage rate.

6. The system of claim 1, wherein at least one of the first fluid and the second fluid is oil.

7. The system of claim 6, wherein the oil is obtained from the borehole.

8. An expandable packer which is responsive to detected packer leakage, comprising:

an outer part positioned at a selected location about a shaft in a borehole;

an inner part disposed within the outer part;

an outer part pump coupled to the outer part and configured to expand the outer part with a first fluid to engage the outer part with an inner surface of the borehole;

a leakage sensor configured to detect a leakage of the first fluid from the outer part which causes at least a portion of the outer part to disengage from the inner surface;

an inner part pump coupled to the inner part and configured to expand the inner part with a second fluid; and a controller to control the outer pump to pump the first fluid into the outer part, and the controller responsive to the detected leakage to control the inner part pump to pump the second fluid into the inner part until at least the disengaging portion of the outer part re-engages the inner surface of the borehole.

9. The system of claim 8, wherein at least one of the outer part and the inner part is composed of a rubber bladder.

10. The system of claim 8, wherein at least one of the outer part and the inner part is composed of a material which swells in response to the first fluid and the second fluid, respectively.

11. The system of claim 8, wherein at least one of the first fluid and the second fluid is stored in a reservoir.

12. The system of claim 8, wherein the sensor is configured to determine a leakage rate, and wherein the controller is configured to control the inner part pump to pump the second fluid into the inner part at a fill rate greater than or equal to the leakage rate.

13. The system of claim 8, wherein at least one of the first fluid and the second fluid is oil.

14. The system of claim 13, wherein the oil is obtained from the borehole.

* * * * *